US005985940A

United States Patent [19]

Manek et al.

[11] Patent Number: 5,985,940

[45] Date of Patent: Nov. 16, 1999

[54] METHOD OF MITIGATING FOULING AND REDUCING VISCOSITY IN PRIMARY FRACTIONATORS AND QUENCH SECTIONS OF ETHYLENE PLANTS

[75] Inventors: Maria B. Manek, Stafford; Chin Hai Chen, Sugar Land; Roberto G. Presenti, W. University; Hernando Diaz-Araúzo, Sugar Land, all of Tex.

[73] Assignee: Nalco/Exxon Energy Chemicals, L.P., Naperville, Ill.

[21] Appl. No.: 09/025,714

[22] Filed: Feb. 17, 1998

[51] Int. Cl.[6] ..... C10G 9/12; C10G 9/16; F17D 1/16

[52] U.S. Cl. ..... 516/31; 137/13; 208/48 AA; 208/48 Q; 507/90

[58] Field of Search ..... 516/31; 507/90; 208/48 AA, 48 Q; 137/13

[56] References Cited

U.S. PATENT DOCUMENTS

| | | | |
|---|---|---|---|
| 4,900,427 | 2/1990 | Weers et al. | 208/48 AA |
| 4,949,743 | 8/1990 | Broom | 137/13 |
| 5,143,594 | 9/1992 | Stephenson et al. | 208/48 AA |
| 5,494,607 | 2/1996 | Manek et al. | 252/308 |

OTHER PUBLICATIONS

Hydrocarbon Processing, Jan. 1991 "Chemicals increase ethylene plant efficiency" Burns et al.

*Primary Examiner*—Richard D. Lovering
*Attorney, Agent, or Firm*—Kelly L. Cummings; Thomas M. Breininger

[57] ABSTRACT

A method is disclosed for mitigating fouling and reducing viscosity in primary fractionators and quench sections of ethylene plants by adding to a hydrocarbon stream a mono and/or a polyalkyl-substituted phenol-formaldehyde resin having a weight average molecular weight of from about 1,000 to about 30,000 and at least one alkyl substituent containing from about 4 to about 24 carbon atoms, which alkyl substituent may be linear or branched.

9 Claims, No Drawings

METHOD OF MITIGATING FOULING AND REDUCING VISCOSITY IN PRIMARY FRACTIONATORS AND QUENCH SECTIONS OF ETHYLENE PLANTS

FIELD OF THE INVENTION

This invention relates generally to antifoulants and, more particularly, to a method of mitigating fouling and reducing viscosity in primary fractionators and quench sections of ethylene plants.

BACKGROUND OF THE INVENTION

In the primary fractionators or oil quench towers of ethylene plants, hot cracked gases from the cracking furnaces are cooled and fractionated to remove fuel oil, pyrolysis gasoline and lighter gases. Unfortunately, the temperatures in the quench oil section lead to the formation of heavy tar molecules via various condensation and polymerization mechanisms. The tar can plug process equipment such as exchangers, trays, etc., as well as reduce the run time of the fractionator column. In addition, coke fines from the cracking furnace may contribute to further heavy fouling in the flow lines and in the tower. In many instances, ethylene plant operators need to inject a lighter stream, such as light cycle oil, into the fractionator bottoms to control tar viscosity in an effort to meet final product specifications. This is always done at great economic expense. All of these problems occur commonly in gas oil crackers that process heavier feedstocks, but may also occasionally appear with lighter feedstocks, especially when increased severity of cracking is applied.

Such problems can be mitigated with specially-formulated antifoulants that will survive high temperatures and inhibit the heavy fouling type components of the quench oil from aggregation and deposition, thus improving the fluid flow characteristics.

Accordingly, it would be desirable to provide an improved method for mitigating fouling and reducing viscosity in the primary fractionators and quench sections of ethylene plants. It would also be desirable to identify a series of additives that will act as fouling inhibitors, tar dispersants and viscosity reducers in cracked hydrocarbon fluids to improve flow characteristics and inhibit precipitation of deposits at high temperatures.

SUMMARY OF THE INVENTION

The present invention calls for adding to a hydrocarbon stream a mono and/or a polyalkyl-substituted phenol-formaldehyde resin having a weight average molecular weight of from about 1,000 to about 30,000 and at least one alkyl substituent containing from about 4 to about 24 carbon atoms, which alkyl substituent may be linear or branched. The addition of the mono and/or polyalkyl-substituted phenol-formaldehyde resin effectively mitigates fouling and reduces viscosity in primary fractionators and quench sections of ethylene plants.

DETAILED DESCRIPTION OF THE INVENTION

This invention is directed to a method for mitigating fouling and reducing viscosity in primary fractionators and quench sections of ethylene plants. In accordance with this invention, an alkyl-substituted phenol-formaldehyde resin is added to a hydrocarbon stream.

The present inventors have discovered that mono and/or polyalkyl-substituted phenol-formaldehyde resins having a weight average molecular weight of from about 1,000 to about 30,000 and at least one alkyl substituent containing from about 4 to about 24 carbon atoms, which alkyl substituent may be a linear or branched alkyl group, effectively inhibit deposition of heavy tars in cracked hydrocarbon fluids at high temperatures. It has also been discovered that the addition of these resins to such fluids reduces their viscosity and improves fluid flow characteristics.

In a preferred embodiment of this invention, the alkyl-substituted phenol-formaldehyde resins are derived from mono or dialkyl-substituted phenols, or mixtures thereof, where the substituents may be linear or branched alkyl groups, each containing from about 9 to about 16 carbon atoms. Preferably, the weight average molecular weight of these resins is from about 2,000 to about 8,000.

In the most preferred embodiment of this invention, the alkyl-substituted phenol-formaldehyde resin is derived from an acid catalyzed or base catalyzed reaction of the mixture of nonyl and dinonylphenols with formaldehyde. The nonylphenol-dinonylphenol-formaldehyde resin preferably has a weight average molecular weight in the range of about 2,000 to about 10,000 and the ratio of nonylphenol to dinonylphenol is from about 12:1 to about 6:1.

The resin of this invention can be added to a hydrocarbon stream in an amount of from about I to about 5000 parts per million (ppm) and preferably in an amount of from about 5 to about 200 ppm. These quantities are conventional for hydrocarbon antifoulants. The resins may be prepared as 15–50% solutions in hydrocarbon solvents in accordance with any conventional manner generally known to those skilled in the art.

EXAMPLES

The following examples are intended to be illustrative of the present invention and to teach one of ordinary skill how to make and use the invention. These examples are not intended to limit the invention or its protection in any way.

Example 1

The following test procedure was used to evaluate the ability of various products to disperse heavy components of quench oil at ambient temperature. The procedure takes advantage of the differing solubility properties of the components of cracked hydrocarbon streams. Hexane is used as a solvent in the procedure. Heavy polycondensed aromatics and tars are insoluble in light hydrocarbons. Therefore, light non-polar solvents, like hexane, promote their precipitation and deposition. The better the dispersant, the more tars will be solubilized in the hexane, and the less sedimentation will be observed. Quench oil samples from two ethylene plants, as well as gas oil that was cracked in a laboratory unit, were used as tar sources.

In the first step of the test procedure, 10 ml of hexane were added to each of four 10 ml graduated centrifuge tubes. The oil sample, previously diluted with toluene (1:1 by volume) was subsequently added at levels of 10, 100, 200 and 300 microliters to each tube. The tubes were then allowed to stand for one-half hour. A dosage of oil which gave from 4% to 10% volume sedimentation after one-half hour was chosen to use in the next step of the test procedure.

In the second step of the test procedure, the precipitation of tars in the presence of dispersants was observed and compared with the sedimentation in a blank sample (no dispersant added). Dispersants were introduced into 10 ml of hexane in graduated centrifuge tubes at the desired dosage (200 or 500 ppm). The aliquots of sample oil, determined in step one, were then added and the tubes were shaken vigorously for about 30 seconds to dissolve the soluble and dispersed components into the non-polar solvent, leaving destabilized tars to settle by gravity. The amount of solids precipitated on the bottom of the tubes was recorded after 15 minutes from the beginning of the test. The measure of performance was the volume percent of dispersed solids in comparison to the blank sample, i.e., the percent of dispersion equals the precipitate volume of the blank minus the precipitate volume of the treated sample, divided by the precipitate volume of the blank, times one hundred.

This procedure was used to evaluate the performance of various oil additives as tar dispersants for the quench oil at ambient temperatures. Additive Nos. 1–5 represent dispersants commonly used to inhibit heavy components of crude oil from deposition under oilfield and refinery conditions, i.e., at low and moderately elevated temperatures (ambient to 300° F.).

Commercial products tested along with the resins of the invention were designated as follows:

| | |
|---|---|
| Commercial product A | A polyisobutylene-maleic anhydride product esterified with polyol |
| Commercial product B | An admixture of nonylphenol-formaldehyde resins and vinyl copolymer sold by Nalco/Exxon Chemical Company, L.P. under the trade name Control-1 |
| Commercial product C | A vinyl polymer based product |
| Commercial product D | An alpha-olefin maleic anhydride based product |
| Commercial product E | An overbased magnesium sulfonate based product |

The dispersant test results are shown below in Table 1.

TABLE 1

| | | % Dispersed | |
|---|---|---|---|
| No. | Additive | 200 ppm | 500 ppm |
| 1 | Commercial product A | 37.2 | 78.0 |
| 2 | Commercial product B | 12.0 | 69.0 |
| 3 | Commercial product C | 12.0 | 15.0 |
| 4 | Commercial product D | 65.6 | 92.7 |
| 5 | Commercial product E | 10.0 | 0 |
| 6 | Nonylphenol-dinonylphenol-formaldehyde resin | 26.7 | 92.7 |
| 7 | Nonylphenol-diethylenetriamine-formaldehyde resin | 54.6 | 92.7 |

Example 2

Commercial products A, D and E and the nonylphenols were further evaluated using the Flocculation Point Test. In accordance with this test, a solution of well stabilized tars in solvent (usually toluene or cyclohexane) was automatically titrated with non-polar hydrocarbon. Changes in solution turbidity were monitored with a specially designed optical probe. Preliminary dilution with non-solvent first increased the solution's transmittance, but then initiated the formation of tar aggregates and a subsequent increase in turbidity (i.e., a decrease in transmittance). A point at the maximum transmittance (Flocculation Point, FP) was designated as the onset of precipitation and measured in milliliters (ml) of consumed titrant. The difference between the flocculation point of the blank and that of the solution with additive was the measure of a dispersant's performance, i.e., the larger the difference, the better the performance.

Table 2 below shows the results of the flocculation tests conducted with two samples of cracked gas oil. Quench oil 1 was sampled from an ethylene plant and Quench oil 2 was cracked in a laboratory cracking unit. The two samples differed substantially in the stability of their tars, as represented by the flocculation points of their corresponding blank samples. Tars in Quench oil 1 were quite stable and a large amount of titrant had to be used to cause the flocculation of the blank. The tars were easily stabilized with each of the dispersants such that no flocculation was observed upon extended titration with heptane. Therefore, no differentiation of performance was made in this case. The other sample of the oil was unstable and the addition of various dispersants showed differences in performance. As illustrated in Table 2, the nonylphenol-dinonylphenol-formaldehyde resin exhibited the best performance.

TABLE 2

| | | Flocculation Point (ml) | |
|---|---|---|---|
| No. | Additive | Quench Oi1 1 | Quench Oil 2 |
| 1 | Blank | 32.1 | 2.8 |
| 2 | Commercial product A | NF* | 3.6 |
| 3 | Commercial product D | NF | 3.4 |
| 4 | Commercial product E | — | 3.0 |
| 5 | Nonylphenol-dinonylphenol-formaldehyde resin | NF | 4.4 |
| 6 | Nonylphenol-diethylenetriamine-formaldehyde resin | NF | 3.0 |

*NF = No flocculation occurred during extended titration.

Example 3

Both of the tests in Examples 1 and 2 were conducted at ambient temperature. However, plant conditions usually involve temperatures between about 350 and 1500 ° F. (approximately 180–800° C.), at which some organic compounds may decompose. Therefore, Differential Scanning Calorimetry (DSC) experiments were conducted in dupicate for the three best additives (products A and D and the nonylphenol-dinonylphenol-formaldehyde resin) from the previous tests to determine thermal stability.

Table 3 combines the decomposition temperatures obtained by the DSC thermal scans from 40 to 500° C. As shown in the Table, the nonylphenol-dinonylphenol-formaldehyde resin has the best decomposition temperature. Because of the possibility that the additive may be exposed to high temperatures in areas such as quench points, it is desirable to use an additive with the highest decomposition temperature.

TABLE 3

| No. | Additive | Decomposition temperature (° C.) |
|---|---|---|
| 1 | Commercial product A | 310 |
| 2 | Commercial product D | 274 |
| 3 | Nonylphenol-dinonylphenol-formaldehyde resin | 410 |

Example 4

Dispersant testing was conducted on quench oil samples with and without the addition of a dispersant. As shown below in Table 4, there was no dispersion of the tars as a function of time (½ to 5 hours) when the blank was used. However, when nonylphenol-dinonylphenol-formaldehyde resin was added to the quench oil, significant dispersion of the tars was achieved.

TABLE 4

| Additive | % Dispersed 300 ppm | % Dispersed 600 ppm |
|---|---|---|
| Blank | 0% | 0% |
| Nonylphenol-dinonylphenol formaldehyde resin | 60% | 100% |

Example 5

Viscosity measurements were also conducted using the same quench oil samples from Example 4 in the laboratory and the results are summarized below in Table 5. The viscosities were measured using a Brookfield viscometer. The quench oil treated with the nonylphenol-dinonylphenol formaldehyde resin (600 ppm) reduced 9% of the original viscosity at room temperature. In an actual ethylene plant, when the same quench oil sample was treated with 300 ppm of additive, the effect on viscosity was much more pronounced due to the dynamics of the system and the temperature. In the field evaluation, the viscosity at the primary fractionator unit was reduced 35% with a unit temperature of 270° C. In another ethylene plant tested, another quench oil sample was treated with 300 ppm of additive and the primary fractionator unit showed a viscosity reduction of 42% at 180° C.

TABLE 5

| Additive | Viscosity at 600 ppm |
|---|---|
| Blank | 56 cps |
| Nonylphenol-dinonylphenol formaldehyde resin | 50 cps |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method of mitigating fouling and reducing viscosity in the quench section of a primary fractionator in an ethylene plant which comprises adding an effective mitigating and reducing amount of an alkyl-substituted phenol-formaldehyde resin to a hydrocarbon stream, wherein the resin is selected from the group consisting of monoalkyl-substituted phenol-formaldehyde resins, polyalkyl-substituted phenol-formaldehyde resins and mixtures thereof, has a weight average molecular weight of from about 1,000 to about 30,000 and has at least one alkyl substituent containing from about 4 to about 24 carbon atoms, which alkyl substituent may be a linear or branched alkyl group.

2. The method of claim 1 wherein the resin is selected from the group consisting of monoalkyl-substituted phenol-formaldehyde resins, dialkyl-substituted phenol-formaldehyde resins and mixtures thereof.

3. The method of claim 2 wherein the alkyl substituent contains from about 9 to about 16 carbon atoms.

4. The method of claim 3 wherein the resin has a weight average molecular weight of from about 2,000 to about 8,000.

5. The method of claim 1 wherein the resin is a nonylphenol-dinonylphenol-formaldehyde resin.

6. The method of claim 5 wherein the nonylphenol-dinonylphenol-formaldehyde resin has a weight average molecular weight of from about 2,000 to about 10,000.

7. The method of claim 6 wherein the nonylphenol-dinonylphenol-formaldehyde resin is made from a mixture of nonylphenol and dinonylphenol in a mole ratio of from about 12:1 to about 6:1.

8. The method of claim 1 wherein the resin is added to the hydrocarbon stream in an amount of from about 1 ppm to about 5,000 ppm.

9. The method of claim 1 wherein the resin is added to the hydrocarbon stream in an amount of from about 5 ppm to about 200 ppm.

* * * * *